US008113857B1

(12) United States Patent
Huang

(10) Patent No.: US 8,113,857 B1
(45) Date of Patent: Feb. 14, 2012

(54) HIGH FREQUENCY CONNECTOR

(75) Inventor: Jinliang Huang, Gongming Town (CN)

(73) Assignee: Shenzhen Electric Connector Technology Co., Ltd., Shenzhen (CN)

( * ) Notice: Subject to any disclaimer, the term of this patent is extended or adjusted under 35 U.S.C. 154(b) by 0 days.

(21) Appl. No.: 13/087,281

(22) Filed: Apr. 14, 2011

(30) Foreign Application Priority Data

Dec. 20, 2010 (CN) ..... 2010 2 0668786 U

(51) Int. Cl.
*H01R 29/00* (2006.01)

(52) U.S. Cl. ..... 439/188

(58) Field of Classification Search ..... 439/188, 439/63, 876; 200/51.1
See application file for complete search history.

(56) References Cited

U.S. PATENT DOCUMENTS 6,585,532 B2 * 7/2003 Uratani et al. ..... 439/188
6,751,317 B2 * 6/2004 Shima et al. ..... 379/438
6,783,374 B2 * 8/2004 Uratani et al. ..... 439/83
6,843,673 B1 * 1/2005 Liu et al. ..... 439/188
6,939,152 B1 * 9/2005 Chen ..... 439/188
7,513,778 B1 * 4/2009 Dar-Shan ..... 439/63
2006/0128195 A1 * 6/2006 Chen ..... 439/188

* cited by examiner

*Primary Examiner* — Tulsidas C Patel
*Assistant Examiner* — Harshad Patel
(74) *Attorney, Agent, or Firm* — Ryan A. Schneider, Esq.; Troutman Sanders LLP

(57) ABSTRACT

An improved high frequency connector including an insulative housing, a shield covering the housing, a first terminal and a second terminal defining a switch and securely contacting with each other in normal position. The housing includes an upper insulating case and a lower insulating case with a central cavity, wherein the contact portion of the first and second terminals are extending inside. The second terminal includes a second fixed portion and a second contact portion that is uniform in width up to the second fixed portion before bending forming. The invention is advantageous in that since the second contact portion of the second terminal is uniform in width up to the end of the second fixed portion before being punched and bent to form a contact area, no abrupt change will incur within that region, and therefore providing consistency of impedance, and thus attaining good signal transmission properties. In addition, by providing, respectively, a convex portion and/or cut-off portion for the first and second terminals to prevent the solder flux that is rising due to surface tension by reflow soldering from reaching the switch area, the invention prevents a disadvantage of poor signal transmission properties due to the increasing contact resistance by flux.

10 Claims, 9 Drawing Sheets

HIGH FREQUENCY CONNECTOR

CROSS-REFERENCE TO RELATED APPLICATIONS

This application claims the benefit of CN Utility Application No. 201020668786.1, filed on 20 Dec. 2010.

BACKGROUND OF THE INVENTION

1. Field of the Invention

The present invention relates to a high frequency connector, and more particularly but not solely to a high frequency connector that is mounted on a circuit board of an electronic device, used as an access point for the communication between alien test equipment and the electronic device to inspect the inner circuit board via a mating connector.

2. Description of Related Art

High frequency connectors are typically mounting on PCBs, e.g. PCBs for mobile phones, where high frequency signals are passing through. In normal working state of the PCB, the connector is arranged to transmit signals, whereas in testing state of the PCB, the high frequency connectors are arranged as an access point to couple to a external test signal generator or other signal measurement equipment for testing the circuit section between two high frequency connectors and thus determine whether the circuit section is functioning properly. Therefore, the transmitting properties of the connector are crucial since the main task of the connector in the normal working state of the PCBs is transmitting signal, and thus it is desirable that loss of signal LOS can be minimized when high frequency signals pass through the connector.

A high frequency connector is disclosed by the applicant in its Chinese patent application No. CN 201038473 published on 19 Mar. 2008, the entire document incorporated herein by reference. Referring to FIG. 1 and FIG. 2, the connector disclosed comprising a shield 81, a first terminal 83, a second terminal 84 and an insulative housing 82 constructed by an insulating guide 821 and an insulating base 822; said shield 81 comprising a cylindrical connecting portion 811 and a shield base 812 formed under the cylindrical connecting portion 811. The shield 81 can be made of any conductive metal sheet and is functioned as a shield of electromagnetic radiation. The cylindrical connecting portion 811 is attached and electrically connected to the central conductor of a cable of a external testing equipment, and the shield 81 is electrically connected with its bottom to a earth welding on a PCB preferably by means of soldering such that a substantially closed shielding and earthing loop is formed and noise originated by electromagnetic radiation is greatly reduced. The insulating guide 821 is contained in the cylindrical connecting portion 811, where the insulating base 822 is fixedly attached in the shield base 812, and a base plate 823 can be attached to the bottom side of the insulating base 822.

The profile of the first terminal 83 and the second terminal 84 is shown in FIG. 2, wherein, the first terminal 83 and the second terminal 84 is extending across the opposite walls of the insulating base 822 respectively and into the insulating base 822 by insert-molding. The first terminal 83 comprising a first fixing section 831, a first contacting section 832 positioned on one side of the first fixing section 831 and bending downward to attach to one point the PCB, and a first spring section 832 positioned on the other side of the first fixing section 831 and is separated from the first fixing section 831 by a neck 834. The connection between the neck 834 and the first spring section 832 is thicker when compared with the neck 834 and the first fixing section 831 respectively. Preferably, the first spring section 832 is disposed at its distal end three contacting fingers 835. The second terminal 84 comprising a second fixing section 841, a second spring section 842 in "V" shape, and a second contacting section 843 bending downward to attach to another point on the PCB. The second fixing section 841 is separated from the second spring section 842 by a neck 844. And the second spring section 842 is thinner when compared with the first spring section 832.

When the connector as described is mounted onto the PCB both the first and the second terminal are soldered on the PCB, during the soldering process, however, respective slit may emerge between the terminals 83, 84 and the insulative housing 82 due to thermal expansion and contraction, through which the melting solder and flux may be drawn into the insulative housing 82 along the respective terminals. As a result, the mutually contact region on the respective terminals 83, 84, especially the first terminal 83 may be contaminated which in turn will increase the impedance in the region of the terminals. Either the increased impedance or vary of impedance along the terminals will degrade the quality of the high frequency signal passing there through.

Furthermore, it is to be noted in the above configuration that a neck of reduced dimension is provided between the second spring section 842 and the second fixing section 841, which may result in high impedance at this position due to the sharp cut-off and will thus degrade transmitting properties of the connector.

In addition, transitions are absent from the positions where the baseplate 823 and the guiding 821 is respectively attached to the insulating base 822 so that in case of loose fitting or deformation after long term use, dust may be absorbed into the insulative housing 822 and attached onto the terminals 83, 84. Attached dust particles may increase the impedance of the mutually contact regions of the terminals and will in turn degrade the transmitting properties of the conductor.

BRIEF SUMMARY OF THE INVENTION

Briefly described, in preferred form, one aspect of the invention is aimed at solving the said technical problem by providing an improved high frequency connector, an insulative housing, comprising an upper insulating case having an opening portion which can receive a center conductor of a mating connector, and a lower insulating case having a central cavity; a shield, covering the housing to be connected electrically to an outer conductor of the mating connector; a first terminal, including a first welding leg used to be soldered on a conductor of a circuit board, a first fixed portion extending from said first welding leg and molded into said insulative housing by insert-molding process, and a first contact portion cantilevered flexible, extending from said first fixed portion and mounted in the central cavity of the insulative housing; a second terminal including a second welding leg used to be soldered on a conductor of a circuit board; a second fixed portion extending from said second welding leg and molded into said insulative housing by insert-molding process, and a second contact portion extending from said second fixed portion and mounted in the central cavity of the insulative housing. The first and second terminals define a switch and securely contact with each other inside the central cavity in a normal position.

According to the present invention, the second contact portion, shaped in a semi-enclosure construction, is formed by scrapless puncturing and bending stamping process from the second fixed portion on the base of a metal sheet, so that the resulted second contact portion is uniform in width with the second fixed portion.

Preferably, said first fixing portion is provided with at least a convex portion to prevent solder flux flowing to the first contact portion.

Preferably, the length of the convex portion is larger than the width of the first welding leg, such that melting solder flux is completely blocked.

Furthermore, the second fixing portion is provided with a cut-off portion, such that the flowing path of the melting solder flux to the second contact portion is blocked or elongated.

Preferably, the length of the cut-off portion is larger than the width of the second welding leg, such that the melting solder flux is completely blocked.

Preferably, a first neck portion is formed in reduced dimension between the first contact portion and the first fixing portion, the resilience force of the first terminal is determined by the length and width of the first neck portion.

Preferably, the width of the first neck portion is no less than the width of the first welding leg.

Preferably, the improved high frequency connector incorporates a receiving groove, communicating with the central cavity, is defined in the lower insulating case and a protruding portion, located between stair portions, is formed on the upper insulating case and the protruding portion is retained in the receiving groove.

Furthermore, the insulative housing of the above improved high frequency connector can also comprises an upper insulating case having an opening portion which can receive a center conductor of a mating connector, a central insulating case having a central opening in the center, and a baseplate portion, the central opening cooperating with the baseplate portion to form a central cavity, such that it is easy to manufacture in large volume.

In addition, the central insulating case include a receiving portion, located on the bottom side of central insulating case and communicating with the central opening, and the baseplate portion is retained in the receiving portion, such that the contact resistance of the switch area is not increased by the possible contamination of outside dust for the improved seal effect of the central insulating case and baseplate portion.

The invention is advantageous in that since the second contact portion of the second terminal is uniform in width up to the second fixed portion before being punched and bent to form a contact area, no abrupt change will incur within that region and therefore almost consistency of impedance is achieved, and thus good signal transmission properties are attained.

In addition, by providing respectively convex portion and/or cut-off portion for the first and second terminals to prevent the solder flux which is rising due to surface tension by reflow soldering from reaching the switch area, thus preventing a disadvantage of poor signal transmission properties due to the increasing contact resistance by flux.

Furthermore, by provided the stair constructions between the upper insulating case and the lower insulating case and/or the central insulating case and baseplate, dust can be blocked from entering into the cavity of the base portion and contamination of the terminals is avoided as a result.

Finally, the dimension of the second neck portion can be modified to be in consistent with the second contact portion, so that consistency of profile of the second terminal, and thus lower impedance is achieved These and other objects, features and advantages of the present invention will become more apparent upon reading the following specification in conjunction with the accompanying drawing figures.

DETAILED DESCRIPTION OF THE INVENTION

Figure 1:
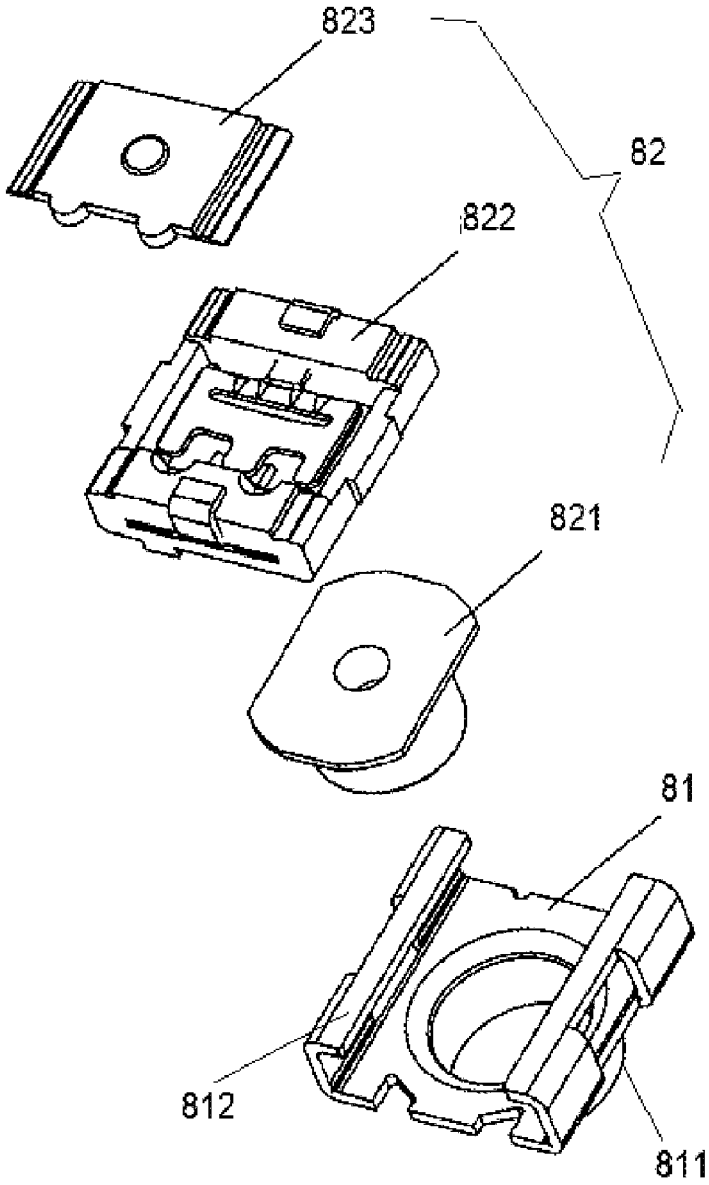
Fig. 1 PRIOR ART
FIG. 1 is an exploded perspective view of a conventional high frequency connector.
Figure 2:
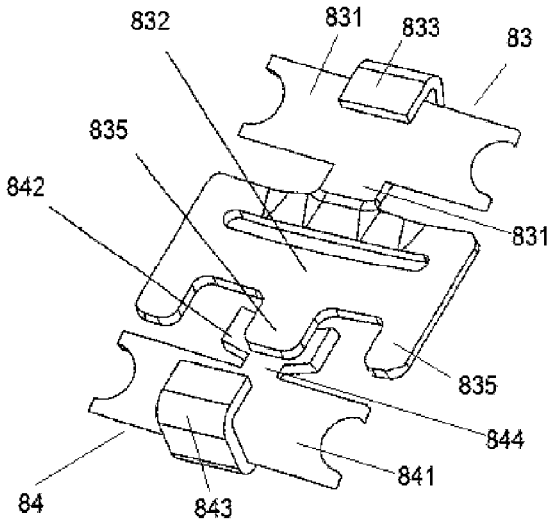
Fig. 2 PRIOR ART
FIG. 2 is the perspective view of a first terminal and a second terminal of the conventional high frequency connector in FIG. 1.
Figure 3A:
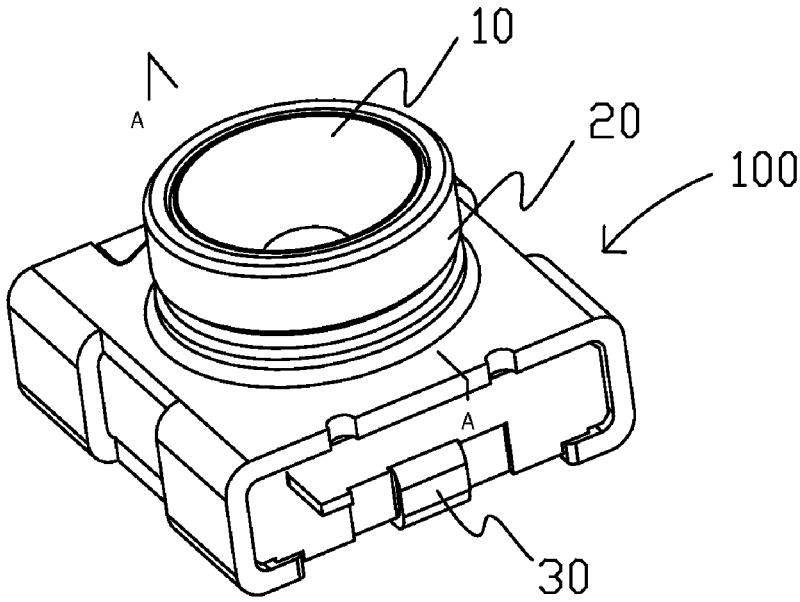
FIG. 3A is a structural view of an improved high frequency connector according to one embodiment of the invention from one perspective.
Figure 3B:
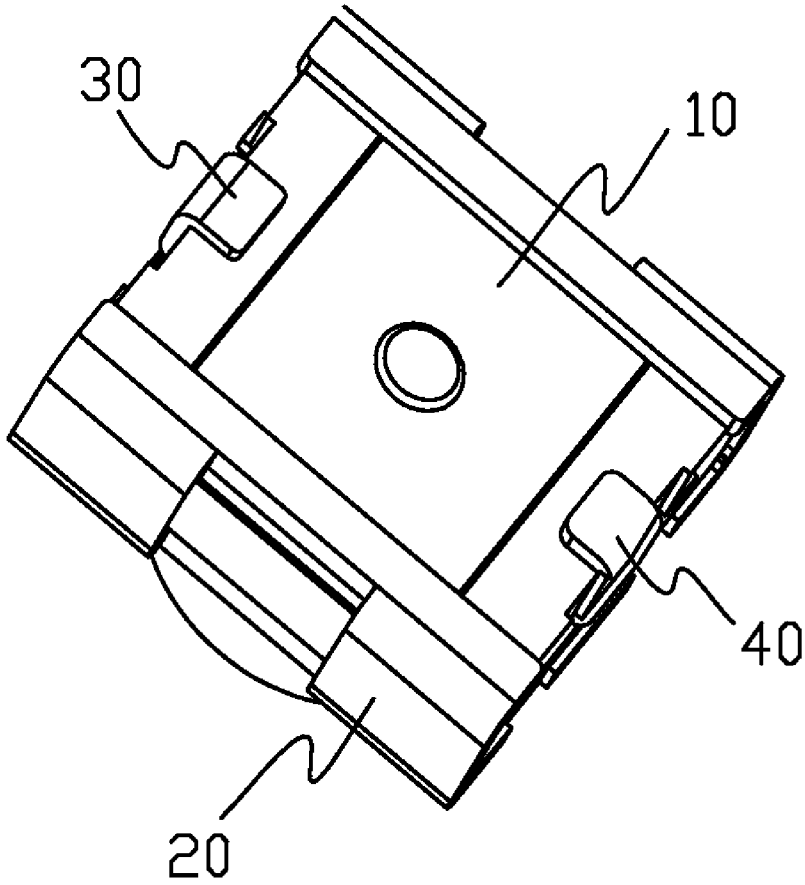
FIG. 3B is a structural view of the improved high frequency connector of FIG. 3A from another perspective.
Figure 4:
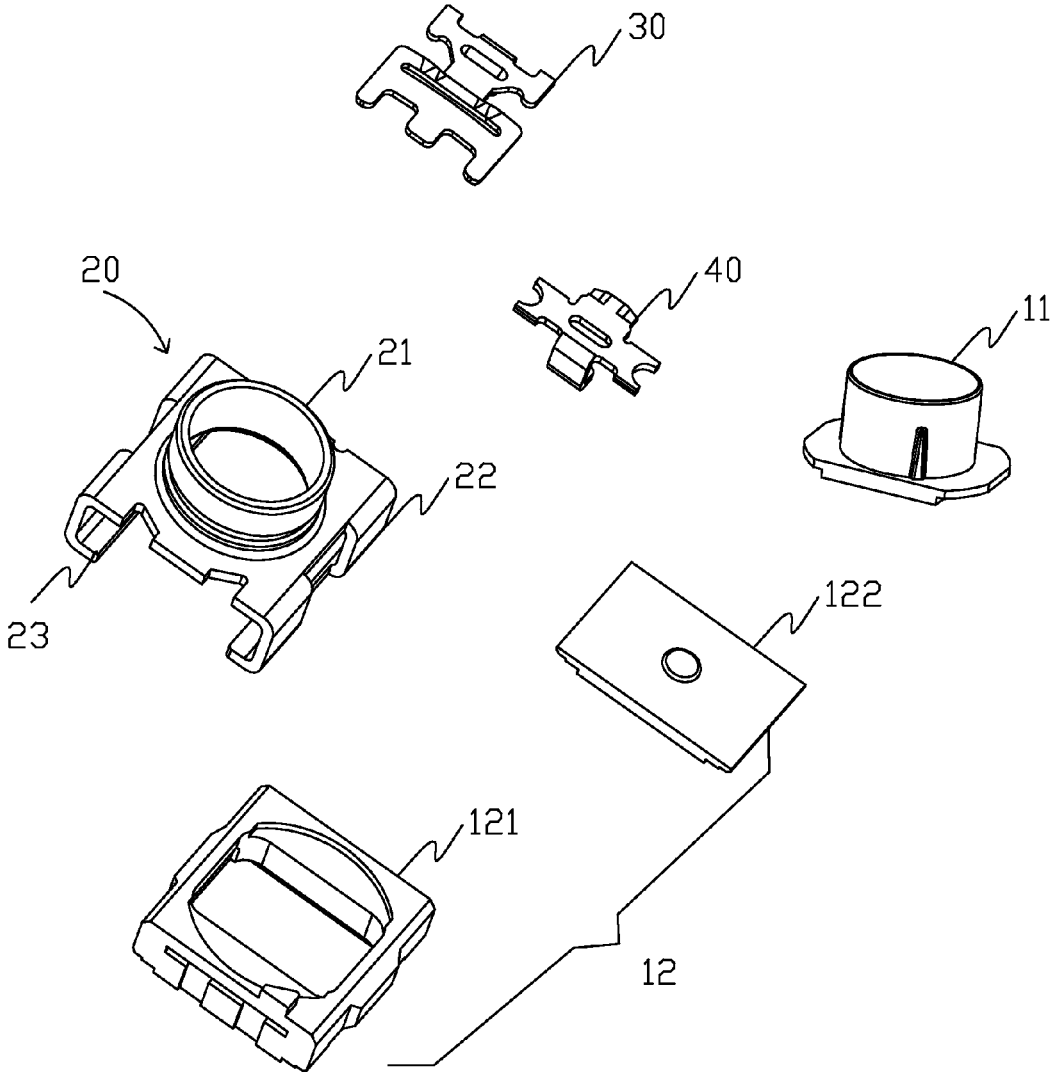
FIG. 4 is an exploded view of the improved high frequency connector according to one embodiment of the invention.
Figure 5:
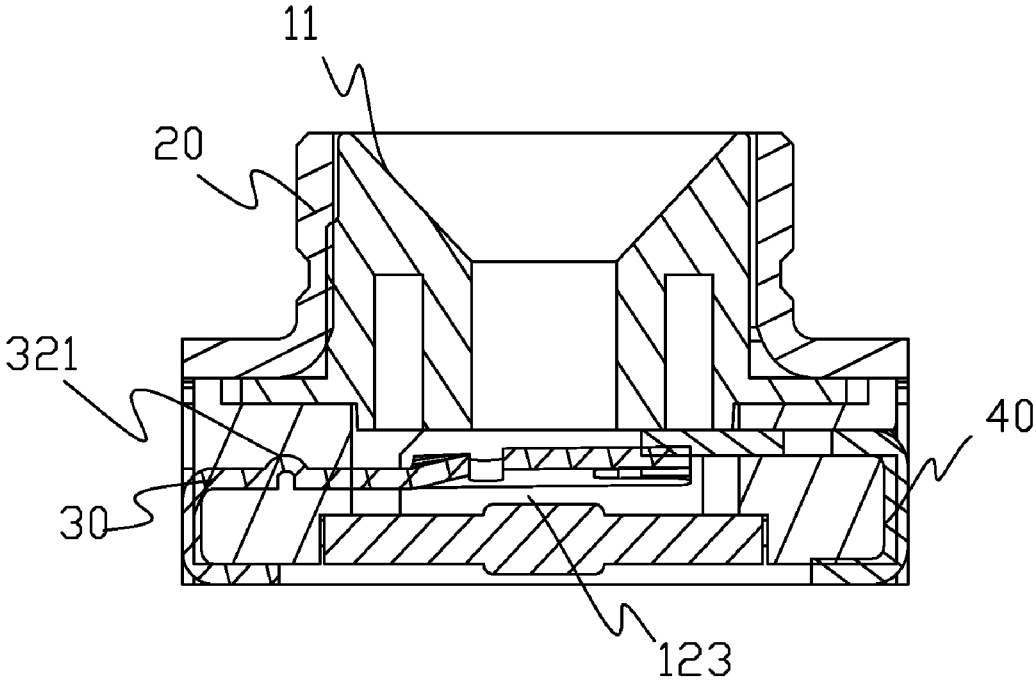
FIG. 5 is an A-A sectional view of the connector as illustrated in FIG. 3A.

To facilitate an understanding of the principles and features of the various embodiments of the invention, various illustrative embodiments are explained below. Although preferred embodiments of the invention are explained in detail, it is to be understood that other embodiments are contemplated. Accordingly, it is not intended that the invention is limited in its scope to the details of construction and arrangement of components set forth in the following description or illustrated in the drawings. The invention is capable of other embodiments and of being practiced or carried out in various ways. Also, in describing the preferred embodiments, specific terminology will be resorted to for the sake of clarity.

It must also be noted that, as used in the specification and the appended claims, the singular forms “a,” “an” and “the” include plural references unless the context clearly dictates otherwise. For example, reference to a component is intended also to include composition of a plurality of components. References to a composition containing “a” constituent is intended to include other constituents in addition to the one named.

Also, in describing the preferred embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from “about” or “approximately” one particular value and/or to “about” or "approximately" another particular value. When such a range is expressed, other exemplary embodiments include from the one particular value and/or to the other particular value.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

Referring to FIGS. 3A, 3B, 4 and 5, the high improved frequency connector 100 according to one embodiment of the invention is comprised of an insulative housing 10, a shield 20 covering the housing 10, and a first terminal 30 and a second terminal 40; the first terminal 30 and the second terminal 40 are molded face to face into the respective walls of the insulative housing 10 so as to forms a switch. The insulative housing 10 comprises an upper insulating case 11 having an opening port, which receives a center conductor of a mating connector (not shown), and a lower insulating case 12 having a central cavity which is partially accommodating the first terminal 30 and the second terminal 40 therein. The insulative housing 10 can be made of any thermoplastic material, and preferably PA8t-GN3232 or its equivalent. The lower insulating case 12 can be injection formed or can be formed by mutually attached central insulating case 121 and a baseplate portion 122.

The shield 20 includes a cylindrical portion 22 wrapping around the upper insulating case 11 of the insulative housing 10, and a shield body 21 for engaging and partially enclosing the lower insulating case 12 of the insulative housing 10 by means of two hook portion 23. The shield 20 can be made of any metal, e.g. steel, silver, copper and manganese or alloy of two and more of these metals. The shield is functioned mainly as a shielding part for preventing the signals transmitted through interconnections on the PCB from electromagnetic radiations generated by the components on the PCB.

The first terminal 30 and the second terminal 40 are molded face to face into the respective walls of the insulative housing 10 and partially extending in the cavity 123 thereof.

Figure 8A:
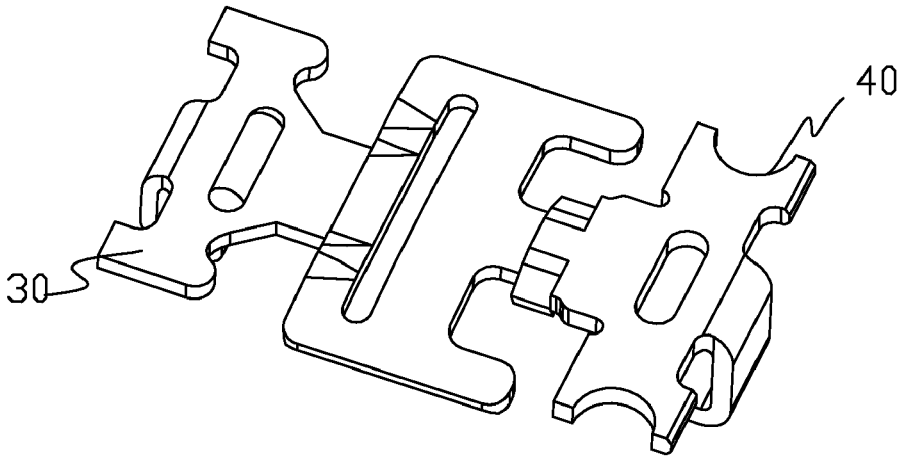
FIG. 8A is a structural view illustrating a contact state of the first terminal and the second terminal.
Figure 8B:
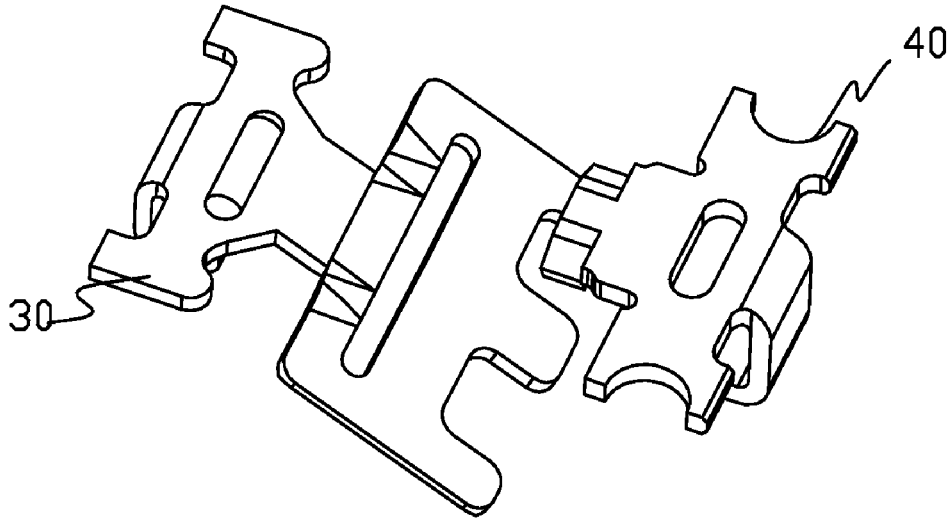
FIG. 8B is a structural view illustrating a detached state of the first terminal and the second terminal.
Figure 9:
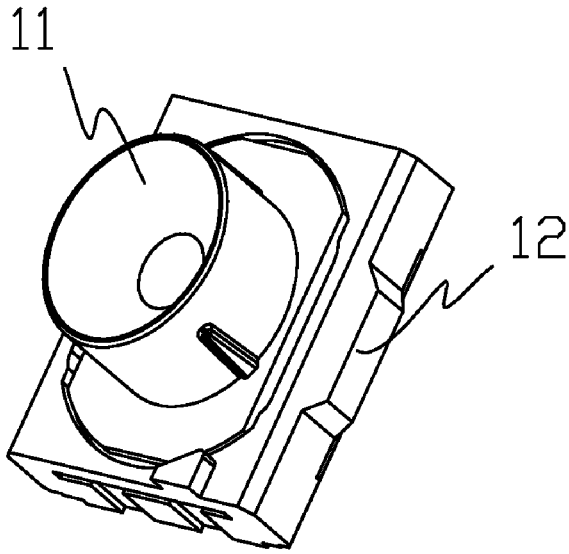
FIG. 9 is a structural view of the insulative housing according to one embodiment of the invention from one perspective.

The operation of the improved connector will be described with reference to FIG. 8A and FIG. 8B:

In a normal working state of the connector, the two terminals 30, 40 is in secure contacting with each other within the cavity 123, so that a signal can be fed from the first terminal 30 to the second terminal 40, as shown in FIG. 8A, thus, reaching the purpose of transmitting high frequency signal for the inner circuit boards; however, when in a testing state of the connector, i.e., a mating connector (not shown) is pushed into the improved connector, the first terminal 30 is moved downward by the center conductor (not shown) of the mating connector against the bias of the second terminal 40, so that the flow of the signal from the second terminal 40 to the first terminal 30 is interrupted. At this time, the outer conductor (not shown) of the mating connector is brought into contact with the shield 20 of the improved connector, so that signals formed on the shield 20 of the improved connector are connected to the outer conductor (not shown) of the mating connector. As a result, the flow of the signal from the first terminal 30 is switched to the center conductor not shown of the mating connector, and therefore connecting to the external signal generator or other testing equipments. Thus, reaching the purpose of as a access point for transmitting inspecting signals between the circuit board of an electronic device and the external signal generator or other testing equipments.

Figure 6A:
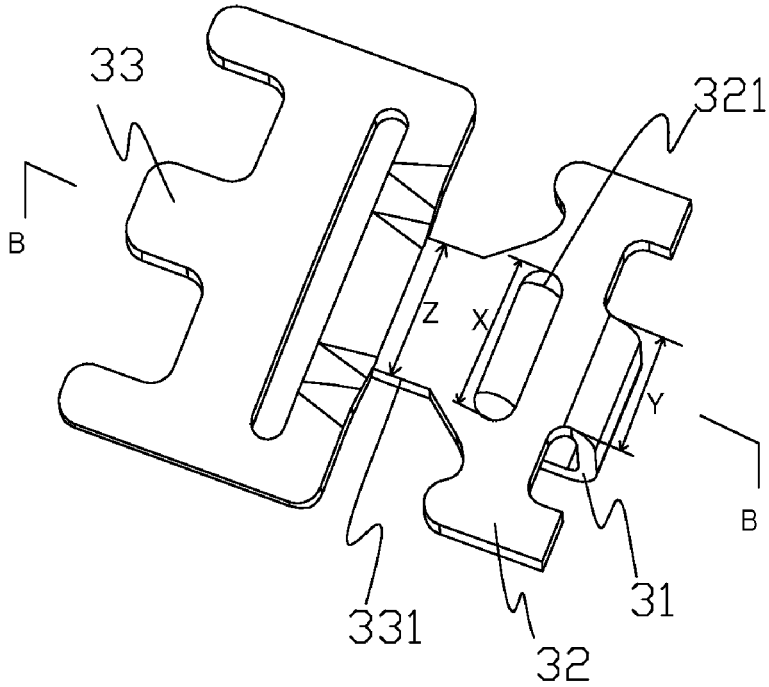
FIG. 6A is a structural view of a first terminal according to an embodiment of the invention from one perspective.
Figure 6B:
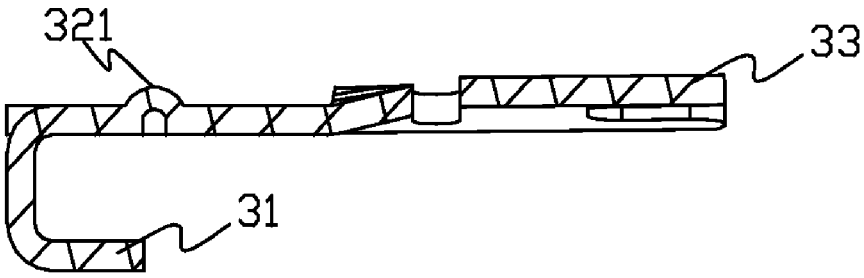
FIG. 6B is a B-B sectional view of the first terminal in FIG. 6A.

Referring to FIGS. 6A and 6B, the first terminal 30 comprising a first welding leg 31 for mounted onto the PCB, a first fixing portion 32 next to the first contact leg 31 for fixedly molded into the lower insulating portion 12 and a first contact portion 33 next to the first fixing portion 32, the first contact portion 33 is extending into the cavity 123 of the insulating portion 12 and can be elastically deformed relative to the first fixing portion 32.

In this invention, a convex portion 321 is provided on the first fixing portion 32 for blocking the melting solder and/or flux when soldering the connector onto the PCB, the length of the convex portion X is preferably larger than the width Y of the first welding leg 31 so that the melting solder and/or flux can be completely blocked from flowing to the first contact portion 33.

A first neck portion 331 with gradually reduced width is formed between the first contact portion 33 and the first fixing portion 32. The elasticity of the terminal 30 can be determined by choosing particular length and width of the first neck portion 331.

The width Z of first neck portion 331 is preferably no less than the width Y of the first welding leg 31 to achieve relatively small impedance.

Figure 7A:
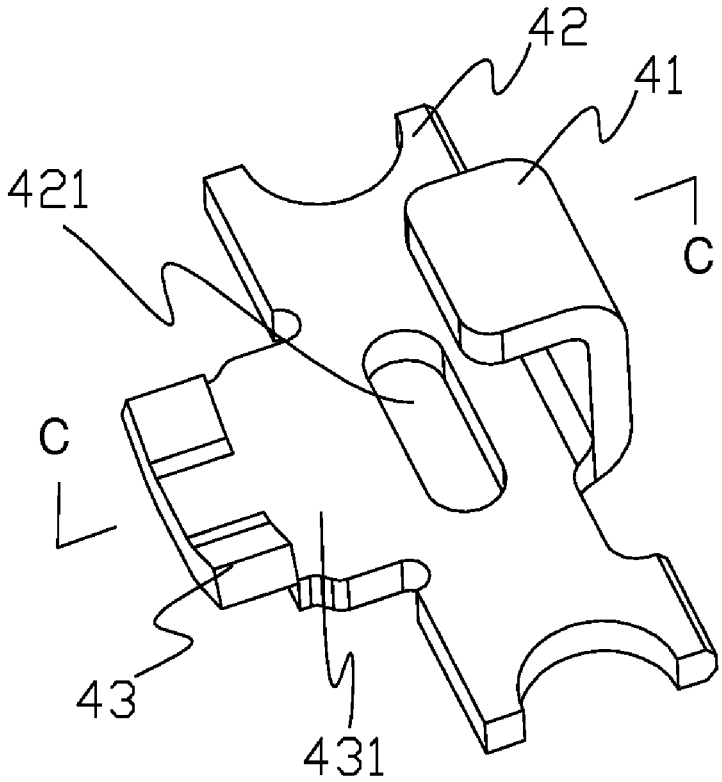
FIG. 7A is a structural view of a second terminal according to an embodiment of the invention from one perspective.
Figure 7B:
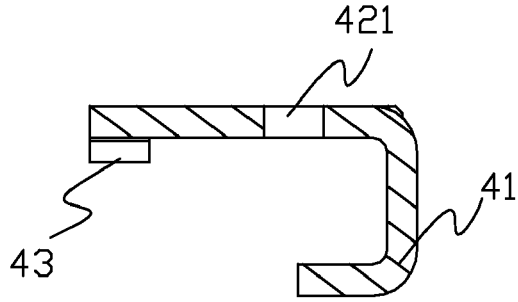
FIG. 7B is a C-C sectional view of the second terminal in FIG. 7A.

Referring now to FIGS. 7A and 7B, the second terminal 40 comprising a second welding leg 41 for attachment onto the PCB, a second fixing portion 42 next to the second welding leg 41 molded into the lower insulating case 12, and a second contact portion 43 next to the second fixing portion 42 which extends inside the cavity 123 of the lower insulating case 12 for securing contacting with the first contact portion 33 downwardly. The second fixing portion 42 is in a position horizontally above the first fixing portion 32 of the first terminal 30, so that the second contact portion 43 is also in a position horizontally above the contact fingers reference signs not allocated of the first contact portion 33.

Similarly, to prevent melting solder and flux flowing into the contact region of the two terminals, a cut-off portion 421, preferably waist shaped, is provided on the second fixing portion 42. And preferably the length of the cut-off portion 421 is no less than the width of the second welding leg 41.

Moreover, the first and the second terminals 30, 40 are made from metal sheets through stamping processes in progressive dies. According to FIG. 7A and FIG. 7B, the main forming process of the second contact portion 43, named as "scrapless puncturing and bending stamping process", is described as following: firstly, in the puncturing stamping station, scrapless puncture the second fixed portion 42 in the predetermined position of the end 431 of the second fixed portion 42, and result in a crack, so that the separated portion of the end 431 can be bent by stamping machine. Secondly, in the bending stamping station, bending the separated portion obtained from the above station takes place to form a contacting portion shaped in a semi-enclosure construction.

As a result, the width of the second contact portion 43 have a width preferably approximate or equal to the width of the end 431 of the second fixing portion 42, so that impedance inconsistency resulting from the abrupt shape change can be eliminated.

Several high frequency connectors according to any of the embodiment describer supra are distributed on several testing points of the circuit on the PCB to divide the circuit into several sections. After relevant circuit components and connectors are soldered on the PCB, interconnectivity and consistency of each circuit section can be tested by connecting the corresponding two external high frequency generator to corresponding connectors, sending high frequency testing signals through one connector then receiving and analyzing output signals from the other.

Figure 10A:
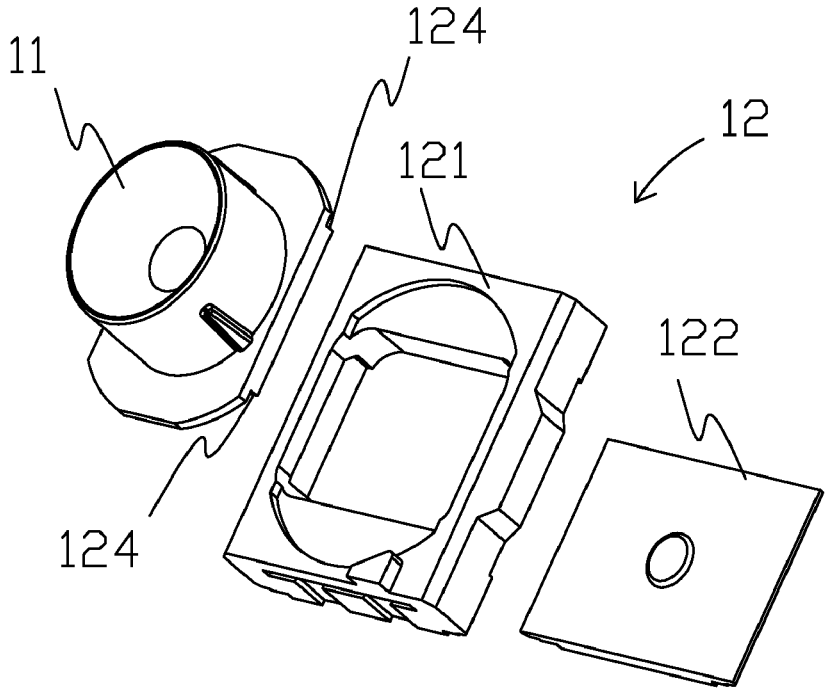
FIG. 10A is an exploded structural view of the insulative housing according to one embodiment of the invention from one perspective.
Figure 10B:
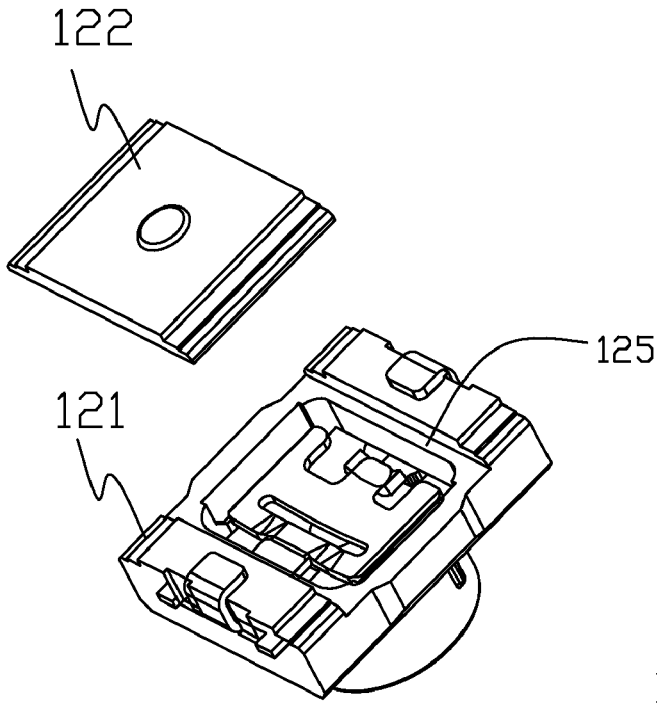
FIG. 10B is a structural view of the insulative housing according to one embodiment of the invention from another perspective.

Furthermore, as illustrated in FIGS. 10A and 10B, the insulative housing 10 is provided with a stair portion 124 in the position where the lower insulating case 12 is attached to the upper insulating case 11, such that mechanical sealing is achieved and dust can be blocked outside the cavity 123 of the housing. In addition, if detachable lower insulating case 12 is implemented for the invention, i.e. the lower insulating case is constructed by a central insulating case 121 and a baseplate portion 122, a receiving portion 125 can also be provided at the position where the baseplate portion 122 is attached to the central insulating case 121, so that dust can be blocked from entering into the cavity 123 of the housing.

While only a certain embodiment of the invention has been specifically described herein, it will be apparent that numerous modifications may be made thereto without departing from the spirit and scope of the invention.

What is claimed is:

1. An improved high frequency connector comprising:

an insulative housing comprising an upper insulating case having an opening portion that receives a center conductor of a mating connector, and a lower insulating case having a central cavity;

a shield covering the housing to be connected electrically to an outer conductor of the mating connector;

a first terminal including a first welding leg used to be soldered on a conductor of a circuit board, a first fixed portion extending from said first welding leg and molded into said insulative housing by an insert-molding process, and a first contact portion cantilevered flexible, extending from said first fixed portion and mounted in the central cavity of the insulative housing; and a second terminal including a second welding leg used to be soldered on a conductor of a circuit board, a second fixed portion extending from said second welding leg and molded into said insulative housing by an insert-molding process, and a second contact portion extending from said second fixed portion and mounted in the central cavity of the insulative housing;

the first and second terminals defining a switch and in secure contact with each other inside the central cavity in a normal position;

wherein the second contact portion, shaped in a semi-enclosure construction, is formed by a scrapless puncturing and bending stamping process from the second fixed portion on the base of a metal sheet, so that the resultant second contact portion is uniform in width with the end of the second fixed portion.

2. The improved high frequency connector according to claim 1, wherein said first fixed portion is provided with at least a convex portion to prevent solder flux flowing to the first contact portion.

3. The improved high frequency connector according to claim 2, wherein the length of the convex portion is larger than the width of the first welding leg.

4. The improved high frequency connector according to claim 1, wherein the second fixed portion is provided with a cut-off portion.

5. The improved high frequency connector according to claim 4, wherein the length of the cut-off portion is larger than the width of the second welding leg.

6. The improved high frequency connector according to claim 1 further comprising a first neck portion formed in reduced dimension between the first contact portion and the first fixed portion, and the resilience force of the first terminal is determined by the length and width of the first neck portion.

7. The improved high frequency connector according to claim 6, wherein the width of the first neck portion is no less than the width of the first welding leg.

8. The improved high frequency connector according to claim 1 further comprising a receiving groove communicating with the central cavity, the receiving groove defined in the lower insulating case, and a protruding portion that is located between stair portions is formed on the upper insulating case and is retained in the receiving groove.

9. An improved high frequency connector comprising:

an insulative housing comprising an upper insulating case having an opening portion that can receive a center conductor of a mating connector, a central insulating case having a central opening in the center, and a baseplate portion, wherein the central opening cooperates with the baseplate portion to form a central cavity;

a shield covering the housing to be connected electrically to an outer conductor of the mating connector;

a first terminal including a first welding leg used to be soldered on a conductor of a circuit board, a first fixed portion extending from said first welding leg and molded into said insulative housing by an insert-molding process, and a first contact portion cantilevered flexible, extending from said first fixed portion and mounted in the central cavity of the insulative housing; and a second terminal including a second welding leg used to be soldered on a conductor of a circuit board; a second fixed portion extending from said second welding leg and molded into said insulative housing by an insert-molding process, and a second contact portion extending from said second fixed portion and mounted in the central cavity of the insulative housing;

the first and second terminals defining a switch and in secure contact with each other inside the central cavity in a normal position;

wherein the second contact portion, shaped in a semi-enclosure construction, is formed by a scrapless puncturing and bending stamping process from the second fixed portion on the base of a metal sheet, so that the resultant second contact portion is uniform in width with the end of the second fixed portion.

10. The improved high frequency connector according to claim 9, wherein the central insulating case includes a receiving portion, located on the bottom side of central insulating case and communicating with the central opening, and the baseplate portion is retained in the receiving portion.

* * * * *